United States Patent [19]

Stavlo

[11] Patent Number: 4,564,109

[45] Date of Patent: Jan. 14, 1986

[54] METHOD AND APPARATUS FOR TRANSPORTING PRESSURIZED GAS CYLINDERS

[75] Inventor: Lars G. Stavlo, Sigtuna, Sweden

[73] Assignee: AGA, A.B., Cleveland, Ohio

[21] Appl. No.: 416,237

[22] Filed: Sep. 9, 1982

[51] Int. Cl.[4] ..... B65D 19/00

[52] U.S. Cl. ..... 206/597; 206/391; 206/443

[58] Field of Search ..... 206/597, 430, 391–394, 206/443; 294/4; 105/463, 466, 486

[56] References Cited

U.S. PATENT DOCUMENTS

| | | | |
|---|---|---|---|
| Re. 22,507 | 6/1944 | Heigis . | |
| 2,203,199 | 6/1940 | Kelly . | |
| 2,218,316 | 10/1940 | Moon . | |
| 2,518,569 | 8/1950 | Pierson . | |
| 2,662,649 | 12/1953 | Gill et al. | 206/597 |
| 2,989,176 | 6/1961 | Hasselhoff | 206/430 |
| 3,253,707 | 5/1966 | Gooding | 206/597 |
| 3,259,249 | 7/1966 | Arts . | |
| 3,602,368 | 8/1971 | Gould . | |
| 3,837,614 | 9/1974 | Palovits et al. . | |
| 3,942,670 | 3/1976 | Mingus et al. . | |
| 4,061,391 | 12/1977 | Violette | 206/597 |
| 4,173,334 | 11/1979 | Lombard . | |
| 4,295,431 | 10/1981 | Stavlo . | |

OTHER PUBLICATIONS

ICG Symposium entitled "Safe Cylinder Handling".

*Primary Examiner*—Joseph Man-Fu Moy
*Attorney, Agent, or Firm*—David A. Burge

[57] ABSTRACT

A group of pressurized gas cylinders are integrated into a unit to prevent relative motion between them, especially during transport, by a system of banding which can be quickly applied when needed and quickly cut away when separation of the cylinders is required. In preferred practice, six cylinders are integrated by arranging the cylinders in an array of paired rows. A central pair of the cylinders is banded tightly together, whereafter end pairs of the cylinders are integrated into the whole by a tight peripheral band surrounding the entire array. In preferred practice, the array of cylinders is integrated within the confines of a pallet which has upstanding posts positioned at the ends of the cylinder array. The posts are located so as to deflect portions of the peripheral band inwardly to increase its degree of wrap around the end pairs of cylinders. Two spacer bars covered by frictional sleeves are supported by the posts and extend between the paired cylinders so that the bands, when applied, force the cylinders against the spacer bars to enhance the integrating effect.

12 Claims, 3 Drawing Figures

METHOD AND APPARATUS FOR TRANSPORTING PRESSURIZED GAS CYLINDERS

CROSS-REFERENCE TO RELATED APPLICATIONS AND PATENT

IMPROVED PALLET FOR PRESSURIZED GAS CYLINDERS, Ser. No. 416,118 filed Sept. 9, 1982, by Lars G. Stavlo, hereinafter referenced to as the "Pallet Case," the disclosure of which is incorporated herein by reference.

DELIVERY SYSTEM FOR PRESSURIZED GAS, Ser. No. 416,238 filed Sept. 9, 1982, by Lars. G. Stavlo, hereinafter referred to as the "Vehicle Case," the disclosure of which is incorporated herein by reference.

PALLET FOR PRESSURIZED GAS CYLINDERS, U.S. Pat. No. 4,295,431 issued Oct. 20, 1981, to Lars G. Stavlo, hereinafter referred to as the "Pallet Patent," the disclosure of which is incorporated herein by reference.

BACKGROUND OF THE INVENTION

1. Field of the Invention

The present invention relates to a method and apparatus for transporting pressurized gas cylinders, and, more particularly, to the use of a particular type of banding system for securing pressurized gas cylinders in a pallet container.

2. Prior Art

The referenced Pallet Patent discloses the use of a pallet for receiving, retaining and facilitating the transportation of pressurized gas cylinders. The pallet described and illustrated in the Pallet Patent features a design which is desirably characterized by simplicity, and which provides a rigid structure for retaining and transporting pressurized gas cylinders. As is explained in the referenced Pallet Patent, chains, ropes or other conventional strap-like fastening devices may be used to facilitate the retention of gas cylinders against the rack-like structure provided by three fixed, rigid, upstanding side walls of the pallet.

While the pallet described in the referenced Pallet Patent is well suited for its intended use, it does not address the often-encountered specialized need for pressurized gas cylinders which are rigidly supported in a pallet for transportation and use as a single unit to dispense a particular type of pressurized gas. Where a plurality of cylinders containing a particular kind of pressurized gas are to be positioned in a pallet for interconnection as a common source of pressurized gas, it is desirable to provide some means to rigidly secure the cylinders in a desired position and to restrict cylinder orientation within the confines of the pallet.

3. The Referenced Applications

The referenced Pallet Case describes additional features of a pallet which may be utilized in conjunction with the practice of the present invention. The referenced Vehicle Case describes features of a vehicle and other inventive features which may be utilized in conjunction with the pallet of the present invention.

SUMMARY OF THE INVENTION

The present invention provides a means for securing pressurized gas cylinders in a pallet for transport and use as a common source of a pressurized gas.

In accordance with the preferred practice of the present invention, an array of six pressurized gas cylinders is arranged in a pallet, with the cylinders being arranged in two side-by-side rows, and with the cylinders in one row paired in juxtaposition with the cylinders of the other row. A first band is reeved around the center pair of cylinders to secure these cylinders as a nucleus of the array. A second band is reeved around the entire array of six cylinders and clamps the four outermost cylinders into engagement with the two center cylinders.

In preferred practice, the pallet includes a pair of spacer bars which extend between the two rows of cylinders so that, when the cylinders are banded together, the cylinders are clamped into engagement with the spacer bars by each of the bands. A pair of upstanding posts are carried by the pallet and extend into the pallet-carrying space near the ends of the spacer bars. When the second band is secured in place, portions of its ends are deflected into the pallet-carrying area by the posts so that the end cylinders are wrapped by the inwardly deflected band portions to a greater degree than would otherwise occur.

BRIEF DESCRIPTION OF THE DRAWING

The foregoing and other features and advantages, and a fuller understanding of the invention, may be had by referring to the following description and claims, taken in conjunction with the accompanying drawing, wherein:

DESCRIPTION OF THE PREFERRED EMBODIMENT

Figure 1:
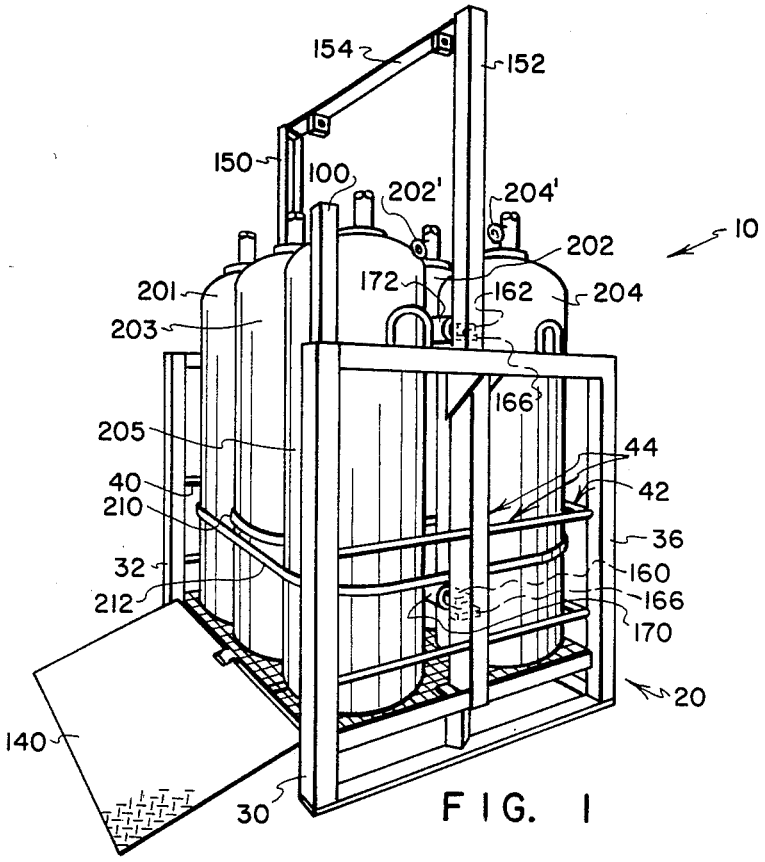
FIG. 1 is a perspective view of a pallet utilized in the preferred practice of the present invention, the pallet being shown loaded with six pressurized gas cylinders, the pallet having its movable side wall retaining structures in their open positions to permit the cylinders positioned in the pallet to be viewed in greater detail.

Referring to FIG. 1, a pallet for transporting pressurized gas cylinders is indicated generally by the numeral 10. The pallet 10 includes a floor structure 20, three upstanding corner posts 30, 32, 34 and a fourth corner post which is hidden by pressurized gas cylinders 200–205 carried on the floor structure 20. The pallet 10 also includes three fixed, upstanding sidewalls 40, 42, 44, and upper and lower movably mounted gate members 100, 140 which provide an openable fourth sidewall. A pallet including these features in greater detail is described in the referenced Pallet Patent.

The pallet 10 has a pair of upstanding center posts 150, 152 interconnected by a cross bar 154. A pair of spacer bars 160, 162 extend between the posts. The spacer bar 160 is positioned at relatively low position between the rows of cylinders, and the spacer bar 162 is positioned relatively high between the rows of cylinders.

Figure 2:
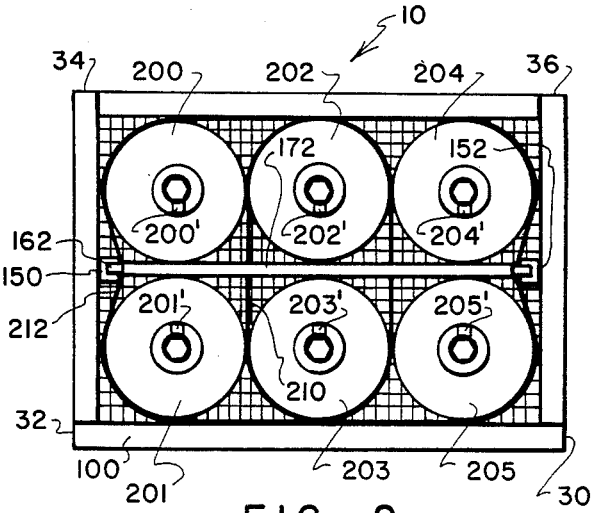
FIG. 2 is a top plan view thereof with the side wall retaining structures in their closed positions, and with upper portions of the center posts and an associated cross-bar being deleted for clarity; and, FIG. 3 is a perspective view showing portions of the pallet and portions of the pressurized gas cylinders positioned therein.

The pallet 10 is designed to carry gas cylinders in two side-by-side rows with the cylinders of one row paired in juxtaposed relationship with the cylinders of the other row. The preferred array includes six cylinders arranged in two side-by-side rows of three cylinders. As best seen in FIG. 2, one row includes the cylinders 200, 202, 204. The other row includes the cylinders 201, 203, 205. The cylinders 200–205 have radially directed connection fittings 200'–205', respectively, which are intended for semi-permanent attachment to a suitable gas distribution piping system. One such system is described in the referenced Pallet Case.

Figure 3:
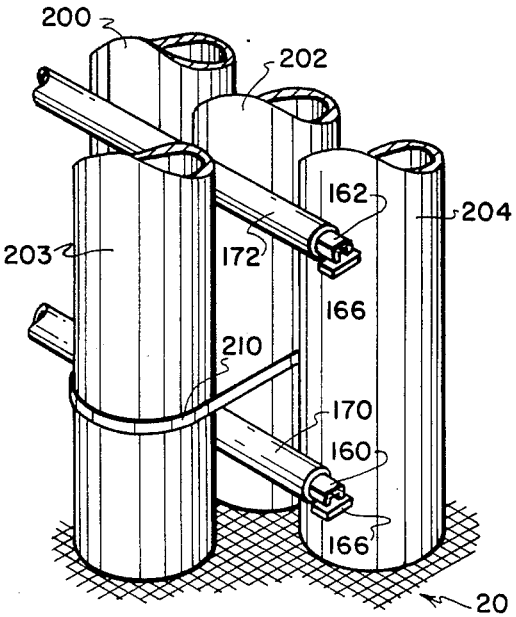

The spacer bars 160, 162 are preferably removable from the pallet 10 in order to expedite loading and unloading of the cylinders 200–205. In the form shown, the posts 150, 152 have channel configurations which open toward each other to receive the ends of the spacer bars 160, 162. Two locating members or stops 166 are carried interiorly of each of the posts 150, 152 to locate and support spacer bars 160 and 162 at the proper levels. The stops 166 are indicated by broken lines in FIG. 1. In FIG. 3, the stops 166 are shown in solid lines in the absence of the post 152 to which the stops 166 are attached. The spacer bars 160, 162 are sheathed by resilient friction sleeves 170, 172, respectively.

For certain specialized uses, it is desired to integrate the cylinders 200–205 to form a semi-permanent unit, and to do so in a manner which will not only render the cylinders secure against relative axial shifting and relative rotation, but which can also be achieved quickly and easily as well as making it possible to speedily separate the cylinders when the need to do so arises.

The present invention addresses this need by utilizing a first steel band 210 which is reeved around the innermost pair of cylinders, i.e., the cylinders 202, 203. The band 210 clamps the cylinders 202, 203 into snug engagement with the friction sleeves 170, 172. A second or peripheral steel band 212 is then reeved around the entire group of six cylinders 200–205, tightened and crimped. The effect of this is to urge each of the four corner cylinders 200, 201, 204, 205 into snug engagement with the adjacent center cylinders 202, 203, and also into snug engagement with the sleeves 170, 172.

The dimensions of the pallet 10 and cylinders 200–205 are preferably such that the center posts 150 and 152 actually project slightly between each of the pairs of adjacent corner cylinders 200, 201 and 204, 205. The presence of the posts 150, 152 serves to increase the degree of wrap of the band 212 about the corner cylinders 200, 201, 204, 205, and this, in turn, enhances the pressure with which these cylinders are caused to press against the center cylinders 202, 203 and against the sleeves 170, 172 surrounding the spacer bars 160, 162.

While the foregoing description calls for the application of only two bands located in close proximity to each other, this paired bonding arrangement may be duplicated at another level on the cylinders. For example, in addition to a single pair of bands 210, 212 located at a level between the spacer bars 160, 162, a second pair of bands applied similarly to the bands 210, 212 may be utilized at a level near the upper spacer bar 162, or elsewhere as desired.

By causing all of the cylinders 200–205 carried by the pallet 10 to be forcibly pressed against the friction material of the sleeves 170, 172, and into snug engagement with each other, cylinders are thusly caused to be integrated and prevented from independently shifting. Likewise, the cylinders 200–205 are caused to retain the same relative orientation and are prevented from relative rotation so that their fittings 200'–205' will be maintained in proper position for coupling with suitable gas distribution piping.

While the invention has been described in terms of an assembly of six cylinders arranged in two rows of three cylinders each, it will be understood that the principle of the invention can be put to use in arrangements involving more than six cylinders, in which case the cylinders, except for the two end pairs, are banded in pairs as has been described in conjunction with cylinders 202, 203. The two end pairs of cylinders are then integrated with the other cylinders by means of a single peripheral band similar to the band 212.

While the optimum arrangement includes integrating the cylinders by way of spacer bars as in the foregoing description, it will be understood that with cylinders which are somewhat smaller and lighter than those contemplated in the present application, effective integration can be achieved by utilizing the described banding arrangement with adjacent ones of the cylinders in direct frictional contact with each other.

Referring to FIG. 3, the process of integrating the cylinders 200–205 may be carried out by setting in place the row of cylinders most remote from the movably mounted gate members 100, 140, namely the three cylinders 200, 202, 204. The spacer bars 160, 162 with their friction sleeves 170, 172 are then set in place with their ends projecting into the channels of the upstanding center posts 152, 154 and resting upon the stops 166. The center cylinder 203 of the remaining row is then set in place directly opposite the cylinder 202, and the band 210 is placed about these two cylinders, tightened and crimped. This results in the condition illustrated in FIG. 3. The procedure is then completed by setting the cylinders 201, 205 in plce, passing the peripheral band 212 about all of the cylinders, and tightening and crimping the band 212, the result being an integrated cylinder package.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A method of producing a package of integrated gas cylinders, comprising the steps of:

(a) arranging an even number of gas cylinders arranged in two side-by-side rows, with there being an equal number of cylinders in each row, with there being at least three cylinders in each row, and with cylinders from one row each being located in close proximity to a seaparate one of the cylinders in the other row to define a linear array of pairs of cylinders;

(b) placing a pair of elongated spacer bars between said rows whereby each said bar engages the cylinder in each row, (c) banding tightly together the cylinders of each pair other than the two end pairs of the array and said spacer bar by using separate bands for banding each of the pairs, with each of the separate bands extending tightly around each of the cylinders of its associated pair for a distance extending through about 180 degrees of the perimeter thereof; and, (d) placing still another band peripherally about the entire array and securing said another band tightly to securely clamp the cylinders of the array and the spacer bars as an integral unit wherein said spacer bars constitute the sole cylinder spacing elements in the multi-cylinder package.

2. The method of claim 1 further including the step of providing the spacer bars with friction enhancing means for enhancing the rigidity of engagement between the spacer bars and the cylinders.

3. A method of producing a package of six integrated gas cylinders, comprising the steps of:

(a) arranging the cylinders in a linear array of two rows each including three cylinders, with each of the cylinders of one row being paired and juxtaposed with a corresponding cylinder in the other row to provide a central pair of cylinders and two end pairs of cylinders;

(b) placing a pair of elongated spacer bars between said rows whereby each said bar engages each cylinder in each row, (c) banding tightly together the cylinders of the central pair by installing at least one band securely about peripheral portions of the cylinders of the central pair, with the band extending tightly around each of the cylinders of the central pair for a distance extending through about 180 degrees of the perimeter thereof; and, (d) placing still another band peripherally about the entire array of cylinders and securing said another band tightly to securely clamp the cylinders of the array and said spacer bar as an integral unit wherein said spacer bars constitute the sole cylinder spacing elements in the multi-cylinder package.

4. The method of claim 3 further including the step of providing the spacer bars with friction enhancing means for enhancing the rigidity of engagement between the spacer bars and the cylinders.

5. A package of integrated gas cylinders which comprises:

(a) an even number of gas cylinders arranged in two side-by-side rows of equal numbers of cylinders with the cylinders defining a linear array of pairs, and with there being at least three cylinders in each row;

(b) a pair of elongated spacer bars between said rows in contact with the cylinders of each row;

(c) separate bands for tightly banding all of the pairs of cylinders and the spacer bar therebetween except the end pairs of the array with a separate band for banding each of the pairs, with each of the separate bands extending tightly around each of the cylinders of its associated pair for a distance extending through about 180 degrees of the perimeter thereof; and, (d) still another separate band tightly peripherally embracing the entire array of cylinders to securely clamp the cylinders of the array and the said spacer bar wherein said spacer bars constitute the sole cylinder spacing elements in the multi-cylinder package.

6. The package of integrated gas cylinders of claim 5 which further includes two spacer bars tightly held between the cylinders of all pairs by the bands.

7. The package of integrated gas cylinders of claim 5 which further includes a friction enhancing material interposed between the spacer bars and the cylinders.

8. A package of integrated gas cylinders which comprises:

(a) six gas cylinders arranged in linear array of two rows of three cylinders each, with each of the cylinders of one row being paired and juxtaposed with a corresponding cylinder in the other row, whereby a center pair of cylinders is bounded on opposite sides by two end pairs of cylinders;

(b) a pair of elongated spacer bars disposed between the rows thereby engage each cylinder of each said pair thereof, (c) a first band tightly embracing the center pair of cylinders and said spacer bar therebetween; and, (d) a second band peripherally embracing the entire array of cylinders and securely clamping the cylinders of the array and said spacer bar therein, wherein said spacer bars constitute the sole cylinder spacing elements in the multi-cylinder package.

9. The package of integrated gas cylinders of claim 8 additionally including a friction enhancing material interposed between the spacer bars and the cylinders.

10. A package of integrated gas cylinders which includes:

(a) a pallet having a floor structure and side walls;

(b) a pair of elongated spacer bars between said rows in contact with the cylinders of each row;

(c) an even number of gas cylinders arranged in a linear array of pairs on said floor structure, with the pairs defining two side-by-side rows of cylinders, with each row containing at least three cylinders;

(d) a separate band tightly embracing each pair of the cylinders except the cylinders of the end pairs of the array;

(e) still another band tightly peripherally wrapped about and embracing the entire array and securely clamping all of the cylinders of the array; and, (f) means projecting inwardly from the side walls of the pallet for deflecting portions of the said another band in a direction to cause an increased degree of wrap of the peripheral band about certain of the cylinders wherein said spacer bars constitute the sole cylinder spacing elements in the multi-cylinder package.

11. The package of integrated gas cylinders of claim 10 which further includes a friction enhancing material interposed between the spacer means and the cylinders.

12. The package of integrated gas cylinders of claim 11 wherein the means projecting inwards from the side walls of the pallet includes two center posts, one adjacent the cylinders of each of the end pairs of the array, which posts also provide means for positioning and releasably supporting the ends of said spacer bars.

* * * * *